US005474200A

United States Patent [19]

Nicholson

[11] Patent Number: 5,474,200

[45] Date of Patent: Dec. 12, 1995

[54] LIDDED CONTAINER HAVING SECURITY HINGE

[75] Inventor: Charles A. Nicholson, Forrest City, N.C.

[73] Assignee: Otto Industries, Inc., Charlotte, N.C.

[21] Appl. No.: 239,318

[22] Filed: May 6, 1994

[51] Int. Cl.[6] ..... B65D 43/14

[52] U.S. Cl. ..... 220/343; 220/342; 16/380

[58] Field of Search ..... 220/342, 343, 220/4.22; 16/380, 381

[56] References Cited

U.S. PATENT DOCUMENTS

| | | | |
|---|---|---|---|
| 112,417 | 3/1871 | Carlton | 16/380 |
| 1,387,794 | 8/1921 | Mantel | 220/343 |
| 4,161,261 | 7/1979 | Frater . | |
| 4,475,266 | 10/1984 | Suska | 16/380 X |
| 4,663,803 | 5/1987 | Gora . | |
| 4,892,221 | 1/1990 | Gora et al. | 220/343 |

*Primary Examiner*—Allan N. Shoap
*Assistant Examiner*—Stephen Cronin
*Attorney, Agent, or Firm*—Bliss McGlynn

[57] ABSTRACT

A lidded container for inventorying, shipping and storing goods having a security hinge including a blind boss disposed at one end of the hinge assembly, an open ended terminal boss disposed at the opposite end of the hinge assembly and a plurality of intermediate hinge bosses extending between the blind and terminal bosses with a hinge wire extending through the intermediate bosses and defining an axis about which the lid moves relative to the container. The terminal boss is open ended having an aperture as well as defining a cavity disposed in spaced relation relative to the axis of the hinge wire. The hinge wire has first and second ends with the first end disposed adjacent the closed end of the blind boss and the second end terminating in an offset portion disposed at an angle relative to the hinge wire axis. The hinge wire has a predetermined length which is less than the predetermined length of the hinge assembly such that the offset portion is captured and retained within the cavity of the terminal boss.

6 Claims, 2 Drawing Sheets

LIDDED CONTAINER HAVING SECURITY HINGE

BACKGROUND OF THE INVENTION

1. Technical Field

The subject invention is directed to a lidded container for inventorying, shipping and storing goods having a security hinge assembly hingedly connecting the lid to the container such that the contents of the container may not be pilfered by entry through the hinge without destructive force to the hinge assembly and container.

2. Description of the Prior Art

The use of lidded containers is wide spread in material handling applications for shipping, storing, and inventorying goods and continues to grow each year. For example as "Just In Time" inventorying policies are adopted by manufactures, distributors, and retail operations, the use of tote box type lidded containers increases. Such containers generally include a base defining a bottom of the container and four sidewalls extending upwardly from the base to define an interior of the container. Typically, two opposed lids are hingedly connected at one end to the upper margins of opposed sidewalls and are movable about the hinge between open and closed positions to either permit or bar access to the goods carried within the interior of the container.

The security of the contents of the container is always a concern. One early attempt to limit pilfering of such containers involved molding tie down apertures in the lids at their free ends and corresponding holes in the sidewalls of the container. The lids were then locked in their closed position by using a security device such as a pad lock through the a lined aperture and hole as shown in FIG. 6 and described at column 4, line 63—Column 5, line 7 of U.S. Pat. No. 4,161,261 issued to Frater on Jul. 17, 1979 for a Security Container.

With the free end of the lids securely locked in their closed position, the hinge connection between the lids and the upper margin of the container sidewalls became the weak spot from a security stand point. The most common hinge connection in such containers is a rod and groove type hinge wherein a hinge wire is threaded through aligned alternating bosses on both the lids and upper margin of the container. However, in this early configuration, the hinge wires could simply be removed and the contents of the container illegally accessed through the opening at the hinge.

In order to combat this problem, the hinge wire was bent at predetermined places after insertion through the aligned bosses as shown at 19 in FIG. 1 of the Frater '261 patent mentioned above. However, this bent hinge wire design required an additional manufacturing step and therefore raised costs.

Another solution provided for hinge wires 12 having a pre-bent "goose neck" portion 14 at one of its terminal ends as shown in FIG. 2 of the drawings. This goose neck portion 14 extends through the open end 16 of the terminal boss 18 of the hinge and is designed to make removal of the hinge wire difficult. While this design achieves its objective, thieves are still able to remove the hinge wire 12 because a small portion extends through the open end 16 of the terminal boss 18 allowing unauthorized persons to manipulate the hinge wire with needle nose pliers or other tools to back the goose neck and then the entire hinge wire out of the bosses. Furthermore, this design was not "idiot" proof in assembly. Often the hinge wire 12 was inserted such that the goose neck 14 was not properly aligned in the terminal boss 18 such that its removal was made all the more easier.

U.S. Pat. No. 4,663,803 issued to Gora on May 12, 1987 discloses a Security Hinge Joint With Separate Hinge Pin which employs a pair of blind or closed ended bosses 20, 22 on either side of the hinge to eliminate access to the hinge wire. However, during assembly of the hinge, the lid and container must be flexed or bent along section lines 35 and 37 respectively as shown in FIGS. 7–9 of this patent. This bend or flexing step adds cost to the manufacturing process and is somewhat dependent on the characteristics of the material used to mold the container and lid as to how much force must be used to manipulate the material to get the ends of the hinge wires into the blind bosses 20, 22.

SUMMARY OF THE INVENTION AND ADVANTAGES

The subject invention overcomes the problems in the prior art in a lidded container for inventorying, shipping and storing goods having a security hinge assembly interconnecting the lid to the container which may be efficiently manufactured, is "idiot" proof in assembly and which effectively denies access to the contents of the container through the hinge assembly absent destructive force to the assembly or container.

The hinge assembly includes a blind boss having a closed end disposed at one end of the hinge assembly and an open ended terminal boss disposed at the opposite end of the hinge assembly and spaced from the blind boss such that the distance therebetween defines a predetermined length of the hinge assembly. A plurality of intermediate hinge bosses extends between the blind and terminal bosses and a hinge wire extends through the intermediate bosses and defines an axis about which the lid moves relative to the container. The terminal boss has an aperture which closely conforms to the circumference of the hinge wire aligned with the hinge wire axis. The terminal boss also defines a cavity disposed in spaced relation relative to the axis of the hinge wire.

The hinge wire has first and second ends. The first end is disposed adjacent the closed end of the blind boss and the second end terminates in an offset portion disposed at an angle relative to the hinge wire axis. The hinge wire has a predetermined length which is less than the predetermined length of the hinge assembly such that the offset portion of the second end of the hinge wire is captured and retained within the cavity of the terminal boss and such that the offset portion is not aligned with the aperture when the hinge wire has been inserted through the boss that it may not be accessed through the aperture or removed without destructive force to the hinge assembly.

Once the offset portion is captured within the cavity, it cannot be manipulated such that the wire may be backed out through the aperture in the terminal boss. Further, the operator need not be conscientious about the orientation of the offset portion when it is inserted into the cavity during assembly as with other prior art hinges. Once it is successfully inserted, the wire cannot be sufficiently accessed even with needle nose pliers or other tools to remove it from the assembly. In this way, the problems of the prior art are overcome in a hinge assembly that greatly improves the security of the contents of the container without increasing manufacturing costs.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
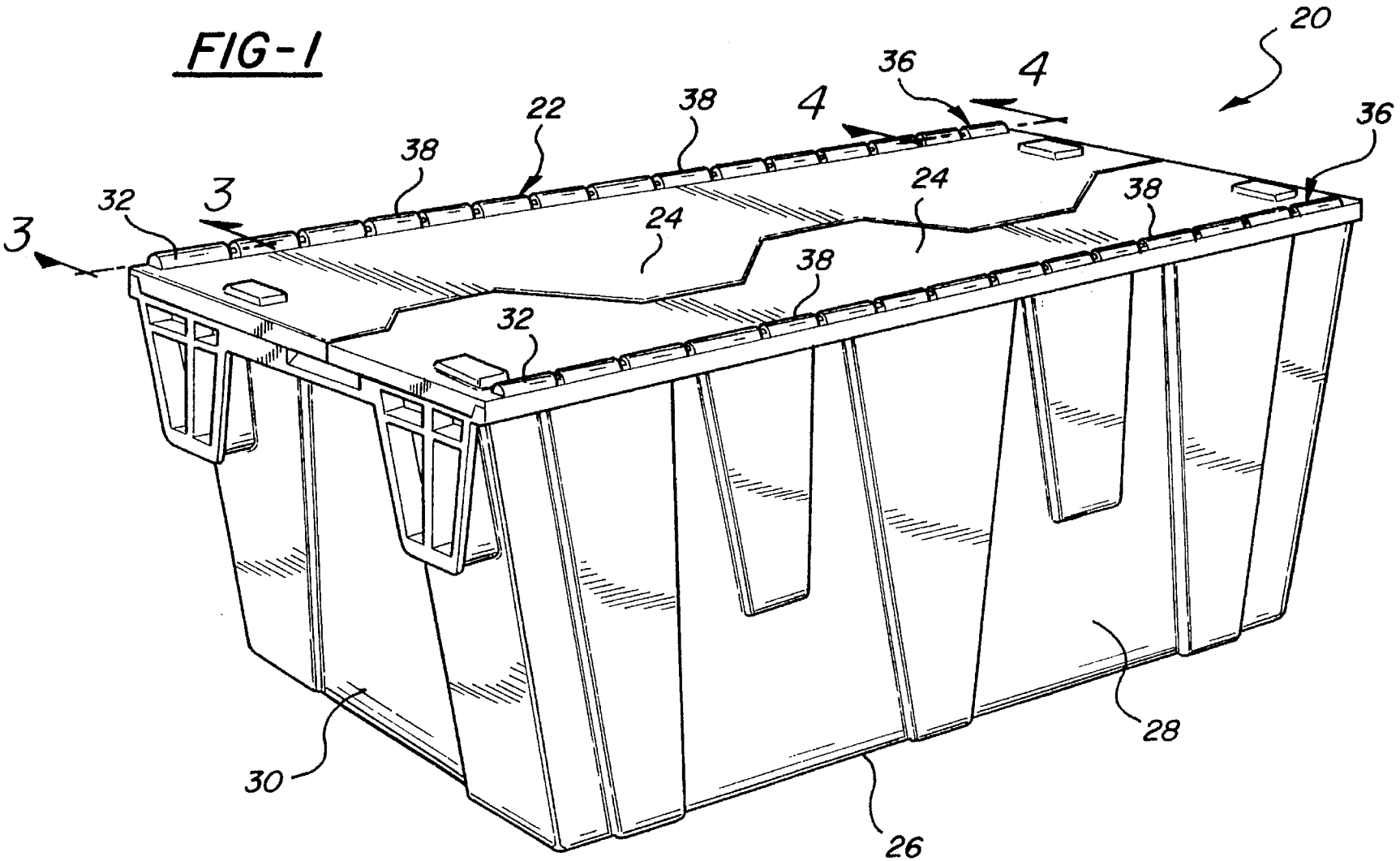
FIG. 1 is a perspective view of a lidded container having the security hinge of the subject invention.

A lidded container for inventorying and storing goods is generally shown at 20 in FIG. 1. The container 20 has a security hinge assembly, generally indicated at 22, which hingedly interconnects lids 24 to the container 20 such that the lids 24 may move between open and closed positions relative to the container 20. The container includes a base 26 which defined the bottom of the container 20, a pair of opposed side walls 28 and a pair of opposed end walls 30. The walls 28, 30 extend upwardly from the base 26 to define an interior of the container 20. The container 20 of the subject invention is typically referred to in the art as a tote box type container manufactured from plastic using injection molding techniques as is commonly known in the art. A container generally of the type disclosed herein is also shown in co-pending U.S. Ser. No. 014,663 entitled Tote Box filed in the name of Eric Stein and assigned to the assignee of the subject invention and is incorporated by reference herein to the extent not inconsistent with the following disclosure.

Figure 4:
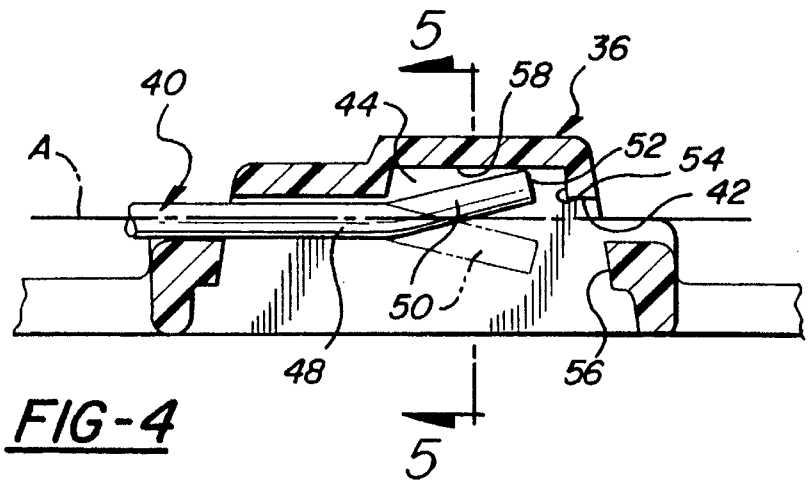
FIG. 4 is a cross-sectional side view of the terminal boss taken along lines 4—4 of FIG. 1.
Figure 5:
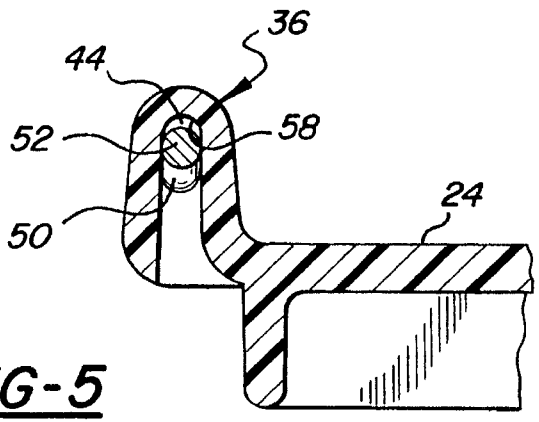
FIG. 5 is a cross-sectional end view of the terminal boss taken along lines 5—5 of FIG. 4.
Figure 2:
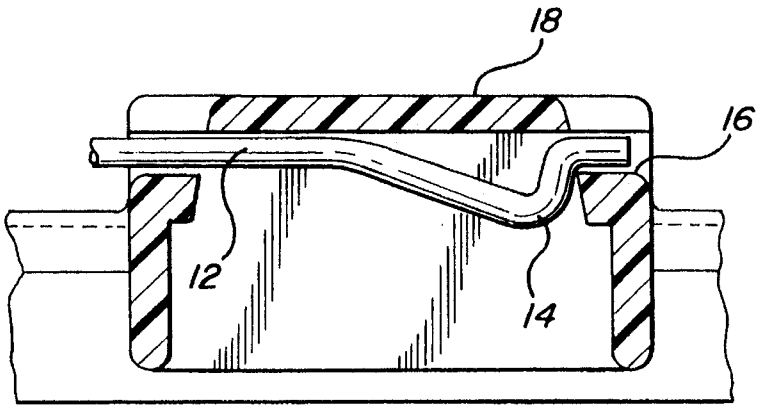
FIG-2 PRIOR ART
FIG. 2 is a cross-sectional side view of a prior art hinge assembly showing a hinge wire having a goose neck type end.
Figure 3:
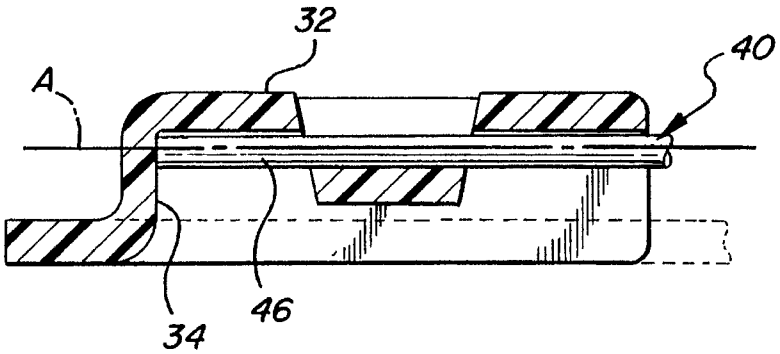
FIG. 3 is a cross-sectional side view of the blind boss taken substantially along lines 3—3 of FIG. 1.

The security hinge assembly 22 hingedly interconnects the lids 24 to the upper portion of the side walls 28 of the container 20 along the edge of the lid 24. The lids 24 are moveable between a closed position baring access to the interior of the container 20 and a open position where access to the interior of the container is not barred. As shown in FIG. 3, the security hinge assembly 22 includes a blind boss 32 having a closed end 34 disposed at one end of the hinge assembly 22 and an open ended terminal boss, generally indicated at 36 as shown in FIG. 4. The terminal boss 36 is disposed at the opposite end of the hinge assembly 22 and spaced from the blind boss 32 such that the distance therebetween defines a predetermined length of the hinge assembly 22. The blind and terminal bosses 32, 36 are molded at the hinged edge of the lids 24 as shown in FIG. 3 and 4 but may just as well be molded to the upper margins of the sidewalls 28. A plurality of intermediate hinge bosses 38 are alternately molded to both the lids 24 and the upper margins of the side walls 28 and extend between the blind and terminal bosses 32, 36 respectively. The intermediate hinge bosses have aligned apertures extending therethrough. A hinge wire, generally indicated at 40, is threaded between the blind and terminal bosses 32, 36 and extends through the aligned apertures in the intermediate bosses 38 and defines an axis A about which the lids 24 move relative to the container.

The terminal boss 36 has an aperture 42 which closely conforms to the circumference of the hinge wire 40 and which is aligned with the hinge wire axis A. The terminal boss 36 defines a cavity 44 disposed in spaced relation relative to the axis A of the hinge wire 40. The hinge wire 40 has first 46 and second 48 ends. The first end 46 is disposed adjacent the closed end 34 of the blind boss 32 as shown in FIG. 3. The second end 48 terminates in an offset portion 50 disposed at an angle relative to the hinge wire axis A as shown in FIG. 4.

The offset portion 50 includes a blunt end 52. The terminal boss 36 includes abutment surfaces 54, 56 which are disposed adjacent the aperture 42 spaced from the hinge axis A and juxtaposed the blunt end 52 of the offset portion 50 so as to prevent the hinge wire 40 from backing out of the bosses 32, 36, 38 through the aperture 42 in the terminal boss 36. More specifically, the cavity 44 defines the upper margin 58 of the terminal boss 36. The abutment surfaces include a flange portion 54 downwardly depending from the upper margin 58 of the terminal boss 36 adjacent the aperture 42 so as to be adapted for abutting contact with the blunt end 52 of the offset portion 50 when the hinge wire 40 is inserted through the bosses such that the offset portion extends upwardly relative to the axis A as shown in solid lines in FIG. 4. The abutment surfaces also include a stop portion 56 disposed adjacent the aperture 42 opposite the flange portion 54. Similar to the flange portion 54, the stop portion 56 is adapted for abutting contact with the blunt end 52 of the offset portion 50 when the hinge wire 40 is inserted through the bosses and the offset portion 50 extends generally downwardly relative to the axis A as shown in phantom lines in FIG. 4.

The hinge wire 40 has a predetermined length which is less than the predetermined length of the hinge assembly 22 such that the offset portion 50 of the second end 48 of the hinge wire 40 is captured and retained within the cavity 44 of the terminal boss 36. The offset portion 50 is not aligned with the aperture 42 when the hinge wire 40 has been inserted through the bosses 32, 36, 38 and as such it may not be accessed through the aperture 42 or removed without destructive force to the hinge assembly 22. More specifically, the terminal boss 36 has a predetermined length along the direction of the hinge axis A. The cavity 44 has a predetermined length along the direction of the hinge axis A which is less than the predetermined length of the terminal boss 36. In other words, the cavity 44 is shorter than the total length of the terminal boss 36. Similarly, the offset portion 50 located at the second end 48 of the hinge wire 40 has a length which is less than the predetermined length of the cavity 44. In this way, the offset portion 50 may be completely captured and retained within the cavity 44 of the terminal boss 36.

Once the offset portion 50 is captured within the cavity 44, the blunt end 52 is disposed adjacent one of the abutment surfaces 54, 56. Therefore, the offset portion 50 cannot be manipulated such that the wire 40 may be backed out through the aperture in the terminal boss 36. Further, the operator need not be conscientious about the orientation of the offset portion 50 when it is inserted into the cavity 44 during assembly as with other prior art hinges. Once it is successfully inserted, the wire 40 cannot be sufficiently accessed even with needle nose pliers or other tools to remove it from the assembly 22.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A lidded container for inventorying, shipping and storing goods having a security hinge assembly hingedly interconnecting the lid to the container such that the lid may move between an open and a closed position relative to the container, said security hinge assembly comprising;

a blind boss having a closed end disposed at one end of said hinge assembly and an open ended terminal boss disposed at the opposite end of said hinge assembly and spaced from said blind boss such that the distance therebetween defines a predetermined length of said hinge assembly, a plurality of intermediate hinge bosses extending between said blind and terminal bosses and a hinge wire extending through said intermediate bosses and defining an axis about which the lid moves relative to the container;

said terminal boss having an aperture which closely conforms to the circumference of said hinge wire aligned with said hinge wire axis, said terminal boss defining a cavity disposed in spaced relation relative to said axis of said hinge wire;

said hinge wire having first and second ends, said first end disposed adjacent said closed end of said blind boss, said second end terminating in an offset portion disposed at an angle relative to said hinge wire axis;

said assembly characterized by said hinge wire having a predetermined length which is less than the predetermined length of said hinge assembly such that said offset portion of said second end of said hinge wire is captured and retained within said cavity of said terminal boss and such that said offset portion is not aligned with said aperture when said hinge wire has been inserted through said bosses that it may not be accessed through said aperture or removed without destructive force to said hinge assembly.

2. A container comprising;

a base defining the bottom of said container, a pair of sidewalls and a pair of end walls extending upwardly from said base to define an interior of said container;

a lid and a security hinge assembly hingedly interconnecting said lid to the upper portion of a sidewall of said container along one edge of said lid, said lid moveable between a closed position barring access to the interior of said container and an open position where access to the interior of the container is not barred;

said security hinge assembly including a blind boss having a closed end disposed at one end of said hinge assembly and a open ended terminal boss disposed at the opposite end of said hinge assembly and spaced from said blind boss such that the distance therebetween defines a predetermined length of said hinge assembly, a plurality of intermediate hinge bosses extending between said blind and terminal bosses and a hinge wire extending through said intermediate bosses and defining an axis about which the lid moves relative to the container;

said terminal boss having an aperture which closely conforms to the circumference of said hinge wire and aligned with said hinge wire axis, said terminal boss defining a cavity disposed in spaced relation relative to said axis of said hinge wire;

said hinge wire having first and second ends, said first end disposed adjacent said closed end of said blind boss, said second end terminating in an offset portion disposed at an angle relative to said hinge wire axis;

said assembly characterized by said hinge wire having a predetermined length which is less than the predetermined length of said hinge assembly such that said offset portion of said second end of said hinge wire is captured and retained within said cavity of said terminal boss and such that said offset portion is not aligned with said aperture when said hinge wire has been inserted through said bosses that it may not be accessed through said aperture or removed without destructive force to said hinge assembly.

3. An assembly as set forth in claims 1 or 2 further characterized by said offset portion having a blunt end, said terminal boss including abutment surfaces disposed adjacent said aperture spaced from said hinge axis and juxtaposed said blunt end of said offset portion so as to prevent said hinge wire from backing out of said bosses through said aperture in said terminal boss.

4. An assembly as set forth in claim 3 further characterized by said cavity defining the upper margin of said terminal boss, said abutment surfaces including a flange portion downwardly depending from said upper margin of said terminal boss adjacent said aperture so as to be adapted for abutting contact with said blunt end of said offset portion when said hinge wire is inserted through said bosses.

5. An assembly as set forth in claim 4 further characterized by said abutment surfaces including a stop portion disposed adjacent said aperture opposite said flange portion so as to be adapted for abutting contact with said blunt end of said offset portion when said hinge wire is inserted through said bosses.

6. An assembly as set forth in claim 5 further characterized by said terminal boss having a predetermined length along the direction of said hinge axis, said cavity having a predetermined length along the direction of said hinge axis which is less than the predetermined length of said terminal boss, said offset portion of said second end of said hinge wire having a length less than the predetermined length of said cavity such that said offset portion may be completely captured and retained within said cavity of said terminal boss.

* * * * *